US011091883B2

(12) United States Patent
Ganz

(10) Patent No.: US 11,091,883 B2
(45) Date of Patent: Aug. 17, 2021

(54) SYSTEM FOR SECURING RAILWAY APPARATUS EQUIPPED WITH A SECURING MECHANISM, AND ASSOCIATED TRANSPORT METHOD AND VEHICLE

(71) Applicant: MATISA MATERIEL INDUSTRIEL S.A., Crissier (CH)

(72) Inventor: Joerg Ganz, Etoy (CH)

(73) Assignee: MATISA Materiel Industriel S.A., Crissier (CH)

( * ) Notice: Subject to any disclaimer, the term of this patent is extended or adjusted under 35 U.S.C. 154(b) by 444 days.

(21) Appl. No.: 16/093,239

(22) PCT Filed: Apr. 11, 2017

(86) PCT No.: PCT/IB2017/052083
§ 371 (c)(1),
(2) Date: Feb. 7, 2019

(87) PCT Pub. No.: WO2017/178968
PCT Pub. Date: Oct. 19, 2017

(65) Prior Publication Data

US 2020/0340188 A1 Oct. 29, 2020

(30) Foreign Application Priority Data

Apr. 12, 2016 (FR) ..... 16/53185

(51) Int. Cl.
*E01B 29/02* (2006.01)
*B61D 3/04* (2006.01)
*B61D 3/16* (2006.01)

(52) U.S. Cl.
CPC ..... *E01B 29/02* (2013.01); *B61D 3/04* (2013.01); *B61D 3/16* (2013.01); *E01B 2204/06* (2013.01)

(58) Field of Classification Search
CPC ..... E01B 29/02; E01B 2204/06; E01B 29/05; E01B 29/16; E01B 29/24; E01B 29/46; B61D 3/04; B61D 3/16
(Continued)

(56) References Cited

FOREIGN PATENT DOCUMENTS

EP 0182958 A1 * 6/1986 ..... E01B 29/02
FR 2016039 A 4/1970
(Continued)

*Primary Examiner* — Zachary L Kuhfuss
*Assistant Examiner* — Cheng Lin
(74) *Attorney, Agent, or Firm* — Laurence A. Greenberg; Werner H. Stemer; Ralph E. Locher

(57) ABSTRACT

A system for securing a railway apparatus includes a support platform and a mechanism for securing the railway apparatus to the support platform, capable of switching from an unlocked state to a locked state. The securing mechanism has a guide rail, a trolley guided by the guide rail along a path which, when the support platform is in the loading position, is parallel to a reference plane, a device for immobilizing the trolley relative to the guide rail, an attachment member for attaching the railway apparatus secured to the trolley; and locking members for locking the guide rail relative to the support platform, which switch from an unlocked position to a locked position when the securing mechanism switches from the unlocked state to the locked state in the loading position of the platform, by urging the guide rail downwards relative to the support platform.

15 Claims, 4 Drawing Sheets

(58) Field of Classification Search
USPC ..... 104/2, 3
See application file for complete search history.

(56) References Cited

FOREIGN PATENT DOCUMENTS

| | | | | | |
|---|---|---|---|---|---|
| FR | 3024470 | A1 * | 2/2016 | ..... | E01B 29/02 |
| FR | 3024470 | A1 | 2/2016 | | |
| WO | 2014154624 | A1 | 10/2014 | | |
| WO | WO-2014154624 | A1 * | 10/2014 | ..... | B61D 3/16 |
| WO | 2016146233 | A1 | 9/2016 | | |
| WO | WO-2016146233 | A1 * | 9/2016 | ..... | E01B 29/02 |

* cited by examiner

SYSTEM FOR SECURING RAILWAY APPARATUS EQUIPPED WITH A SECURING MECHANISM, AND ASSOCIATED TRANSPORT METHOD AND VEHICLE

FIELD OF THE INVENTION

The invention relates to a system for securing railway apparatus, and notably a switch. It also relates to a transport vehicle, notably a wagon, incorporating such a securing device. Finally, it relates to a method for securing rail apparatus and, more generally, to a method for transporting rail apparatus.

PRIOR ART

Document FR3024470 describes a wagon for transporting railway apparatus, comprising a railway apparatus support platform having a bearing surface for the railway apparatus, the support platform being able to move between a horizontal loading position and an inclined transport position. The rail apparatus is fixed to the support platform by a securing mechanism made up of individual clamps, distributed over the entire railway apparatus, positioned between the cross-ties of the rail apparatus and the platform.

Such a fixing method, which is particularly simple, does, however, have the disadvantage of requiring access to the loading platform in order to tighten the clamps by hand, and therefore before the rail apparatus has been secured. Special precautions therefore need to be taken for handling both during the loading phases and the unloading phases, to ensure the personal safety of those involved.

In order to be able to fix the rail apparatus to the platform without the need to access the platform, the company MATISA SA has, since 2006, been marketing at least one rail apparatus securing mechanism comprising fixing bars which at one end have a hook intended to engage with part of the base of a rail of the rail apparatus. Each bar is mounted with the ability to slide in a sleeve articulated to the platform in such a way as to pivot about a longitudinal axis which is perpendicular to the bar. The operator can thus maneuver the bar in the manner of a lever, holding it by its opposite free end to the hook, in order to make it pivot until the hook approaches the rail base, while adjusting the working length of the bar by sliding it in the sleeve. Once the hook is engaged with the base of the rail, all that remains is for the sliding of the bar in the sleeve to be blocked in order to lock the hook and the rail apparatus in position relative to the platform. The length of the bar allows the operator to work while remaining some distance from the hook, on the side of the platform. The system thus described is very similar to the system illustrated in document WO2014154624A1. It is effective, but does not allow a very high clamping force to be obtained between the hook and the rail apparatus, particularly since the force applied by the hook to the base of the rail during placement and immobilization is in the overall direction of the bar, slightly oblique with respect to the horizontal, and therefore with a high horizontal component that tends to cause the rail apparatus to slip on the platform. Furthermore, this device is difficult to motorize.

SUMMARY OF THE INVENTION

The invention seeks to overcome the disadvantages of the prior art and to provide a system for securing railway apparatus which allows simple and secure handling of the railway apparatus and which is simple to motorize.

In order to achieve this, a first aspect of the invention proposes a system for securing railway apparatus, comprising:

- a support platform able to be positioned in a loading position, and
- at least one mechanism for securing the railway apparatus to the support platform, able to pass from an unlocked state into a locked state.

The securing mechanism comprises:

- at least one guideway;
- at least one carriage guided by the guideway along a path which, when the support platform is in the loading position, is situated in a reference plane, the carriage being moved along the guideway by a motorized or nonmotorized, preferably self-locking, drive mechanism;
- means for blocking the carriage with respect to the guideway;
- at least one railway apparatus fixing member, secured to the carriage; and
- members for locking the guideway with respect to the platform, which members pass from an unlocked position to a locked position when the securing mechanism passes from the unlocked state to the locked state with the support platform in the loading position, urging the guideway downward with respect to the support platform.

The movement of the fixing member is thus broken down into at least two components, namely a horizontal movement of the carriage bearing the fixing member and a downward vertical movement of the guideway guiding the carriage, albeit of very small amplitude. This breakdown allows the rail apparatus to be secured to the platform in a procedure that is mastered in a number of successive steps, namely first of all by positioning the fixing member, which if appropriate includes moving the carriage along the path defined by the guideway, and then in a second phase, locking by forcing the guideway downward.

The support platform is preferably horizontal in the loading position. However, it may be inclined, this inclination being less than in the transport position. The reference plane is connected with the support platform and preferably parallel to the support platform. For preference, the resultant of the loads induced by the locking member on the guideway and the fixing members do not include a component for translational movement in the reference plane.

The path of the carriage as defined by the guideway is preferably a straight path.

The carriage is moved along the guideway by a motorized or nonmotorized, preferably self-locking drive mechanism. The drive mechanism may for example comprise a hydraulic or pneumatic piston actuator, or call upon a rotary motor, notably an electric motor, and a transmission that converts the rotary movement of the drive shaft into a movement of the carriage along the path defined by the guideway. Here it is possible to conceive of any appropriate transmission mode, for example cable and pulleys or transmission chain, rack and pinion. In order to obtain a self-locking effect for the drive mechanism, the choice will preferably be made to interpose between the motor and the carriage an irreversible transmission mechanism, for example a leadscrew mechanism. It is also possible to conceive of having, in place of a motor, a crank connected to the carriage by a transmission mechanism, preferably an irreversible mechanism.

For preference, the carriage drive mechanism comprises a driving and/or operating member situated on one side of the platform. The operator can thus remain outside of the platform during the operation of fitting the fixing member.

According to one particularly advantageous embodiment, the locking mechanism is such that when the platform is in the horizontal loading position and the securing mechanism is in the locked state, the guideway has at least one degree of freedom in translational movement with respect to the platform in a horizontal longitudinal direction, preferably with a travel of at least 50 cm, and preferably at least one degree of freedom to rotate about a vertical axis, preferably with an angular travel of at least 10°. The orientation of the guideway gives a large degree of freedom in the positioning of the rail apparatus fixing member with respect to the rail apparatus, and therefore allows the securing system to adapt to rail apparatus with various configurations, or which have not been positioned precisely on the platform.

For preference, the locking members are driven from the unlocked state into the locked state by a motorized actuator and/or an energy accumulator, preferably self locking. By combining motorization of the locking member and motorization of the carriage, a fully motorizing securing mechanism is obtained.

According to one particularly advantageous embodiment, the fixing member is able to move with respect to the carriage between at least a retracted position and a fixing position, the fixing member in the retracted position being situated, when the support platform is in the loading position, beneath a fixing plane parallel to the reference plane and preferably situated above the guideway and the carriage, and the fixing member in the fixing position being situated, when the support platform is in the loading position, at least partially above the fixing plane. For preference, the fixing member is moved by a motorized actuator and/or an energy accumulator, preferably self locking, between the retracted position and the fixing position. According to one embodiment, the fixing member is able to move rotationally about an axis of pivoting between the retracted position and the fixing position. The fixing member may for example pivot about an axis of rotation that is fixed with respect to the carriage are also conceivable, for example a deformable-parallelogram connection.

The fixing member preferably comprises at least one catching zone intended to catch on part of the rail apparatus, preferably a rail, although it is also conceivable to catch on a crosstie of the rail apparatus. According to one embodiment, the fixing member comprises two catching zones situated, when the support platform is in the loading position and the fixing member is in the fixing position, at different heights.

In practice, the support platform is preferably able to move between the loading position and an inclined transport position, preferably by rotating about at least one horizontal axis of pivoting. For preference, the path of the carriage extends at least in a direction perpendicular to the axis of pivoting.

According to one particularly advantageous embodiment, the securing mechanism further comprises:

- at least one other guideway secured to the guideway;
- at least one other carriage guided by the other guideway along a path which, when the support platform is in the loading position, is parallel to the reference plane;
- means for blocking the other carriage with respect to the other guideway; and
- at least one other railway apparatus fixing member, secured to the other carriage.

In practice, the two guideways may be in the continuation of one another along the one same transverse beam of the securing mechanism, or may be parallel to one another but offset, on two transverse beams of the securing mechanism which are secured to one another.

For preference, the fixing member and the other fixing member have catching zones for catching on the railway apparatus, which zones face toward one another or face in the one same transverse direction, and are each able to catch on a rail base of the railway apparatus.

Another aspect of the invention relates to a vehicle for transporting railway apparatus, particularly a wagon for transporting railway apparatus, comprising a securing system as described hereinabove, mounted on a transport chassis supported by sets of bogies.

Another aspect of the invention relates to a method for transporting railway apparatus, comprising the following operations:

- the railway apparatus is placed on a support platform positioned in a loading position,
- a carriage bearing a fixing member is positioned along a planar path of a guideway of the carriage so as to bring the fixing member into engagement with the railway apparatus;
- the guideway is stressed by the application of loads the resultant of which is downward, and the guideway is locked in a locked position.

The positioning of the carriage is preferably performed by motorized, preferably self-locking, means. Similarly, the movement of the guideway is preferably brought about by motorized means, preferably self locking.

After having positioned the carriage and before stressing the guideway, the carriage is preferably blocked in position with respect to the guideway. This blocking is obtained automatically, if the mechanism, be it motorized or nonmotorized, that moves the carriage is irreversible.

In order to engage the fixing member with the railway apparatus, the fixing member is preferably moved with respect to the carriage from a retracted position into a fixing position, before, during, or after the positioning of the carriage bearing the fixing member.

BRIEF DESCRIPTION OF THE FIGURES

Further features and advantages of the invention will become apparent from reading the following description, with reference to the attached figures which illustrate.

For greater clarity, elements that are identical or similar are identified by identical reference symbols throughout the figures.

DETAILED DESCRIPTION OF EMBODIMENTS

Figure 1:
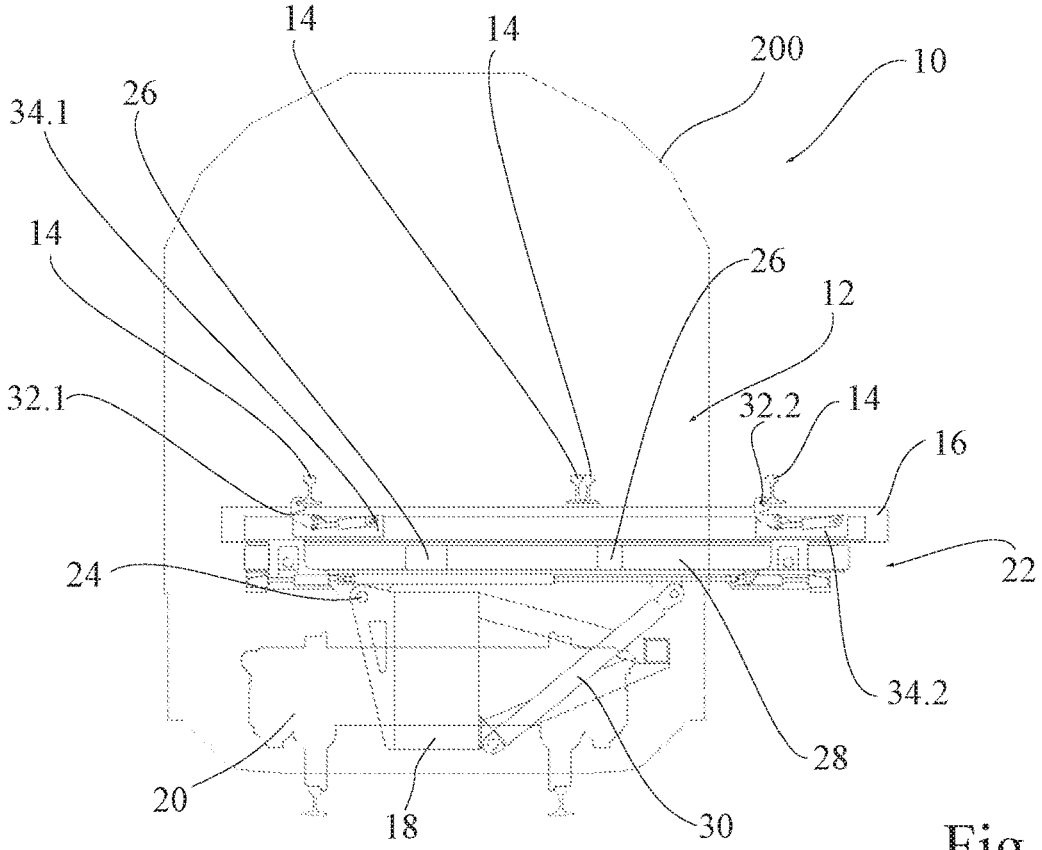
FIG. 1, a schematic front view of a wagon for transporting rail apparatus incorporating a rail apparatus securing system according to a first embodiment of the invention, in a loading position.
Figure 2:
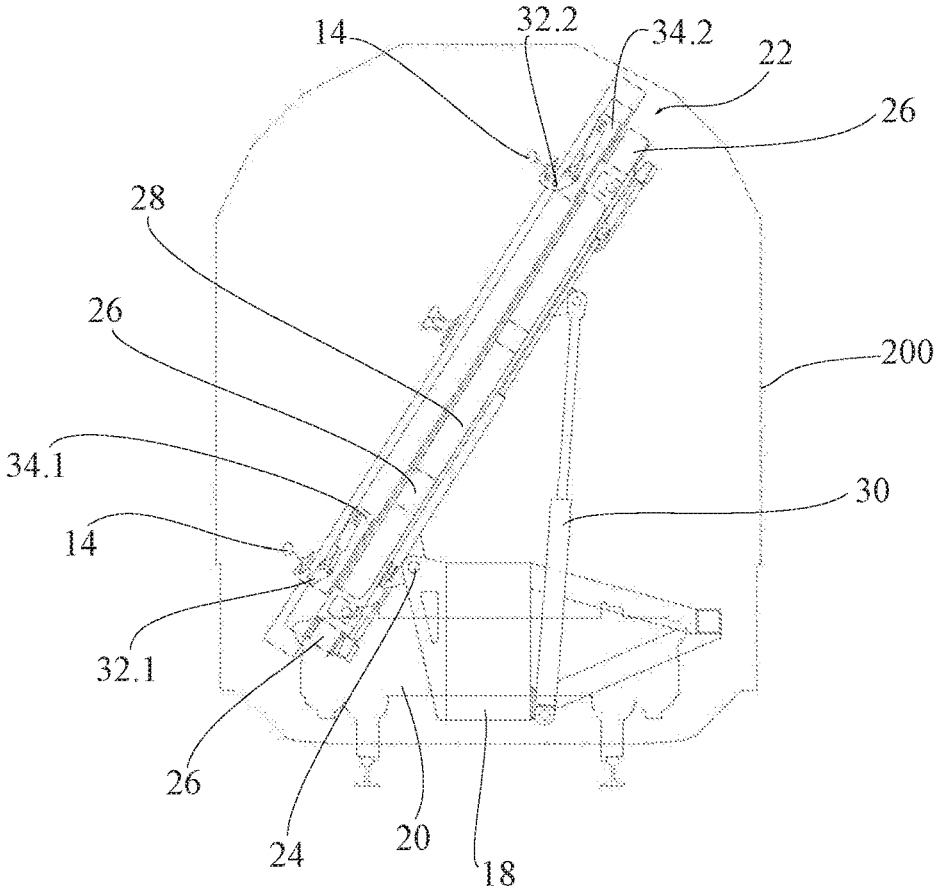
FIG. 2, a schematic front view of the transport wagon of FIG. 1, the rail apparatus securing system being in a transport position.

FIGS. 1 and 2 illustrate a transport wagon 10 in the process of loading rail apparatus 12 of a large size, and notably of a width that exceeds the running envelope 200 prescribed for rail transport, for example a switch 12 comprising rails 14 and crossties 16.

The transport wagon 10 comprises a chassis 18 the width of which is less than or equal to the width of the running envelope 200, defining a longitudinal axis perpendicular to the plane of FIG. 1 and supported by two sets of bogies 20. An inclinable platform 22 for loading and supporting the rail apparatus 12 is articulated to the chassis 18 by an articulation 24 allowing pivoting about a horizontal axis parallel to the longitudinal axis of the chassis 18. If appropriate, the inclinable support platform 22 may be in two or more parts. The support platform 22 is preferably an all-welded structure and has longitudinal members 26 and cross members 28. In the loading and unloading position illustrated in FIG. 1, the inclinable support platform 22 here is horizontal. A reference plane for the platform, parallel thereto and also horizontal in the loading position, is thus defined. One or more hydraulic rams 30, or any other type of motorized actuator, allow the inclinable support platform 22 to be pivoted between the loading and unloading position and an inclined transport position illustrated in FIG. 2.

In order to secure the rail apparatus 12 to the support platform 22 there is a securing mechanism illustrated in FIGS. 3 to 7. This securing mechanism is made up of fixing members 32.1, 32.2, in this instance hooks, mounted on carriages 34.1, 34.2 which are guided on guideways 36.1, 36.2 that can be positioned and fixed on the support platform 22, parallel to the reference plane. Each fixing member 32.1, 32.2 is secured to the associated carriage 34.1, 34.2 by a pivot connection 38.1, 38.2. A self-locking actuator 40.1, 40.2, also borne by the carriage 34.1, 34.2, allows the fixing member 32.1, 32.2 to be pivoted between a retracted position illustrated in FIGS. 3 and 4 and a fixing position illustrated in FIGS. 6 and 7.

Figure 6:
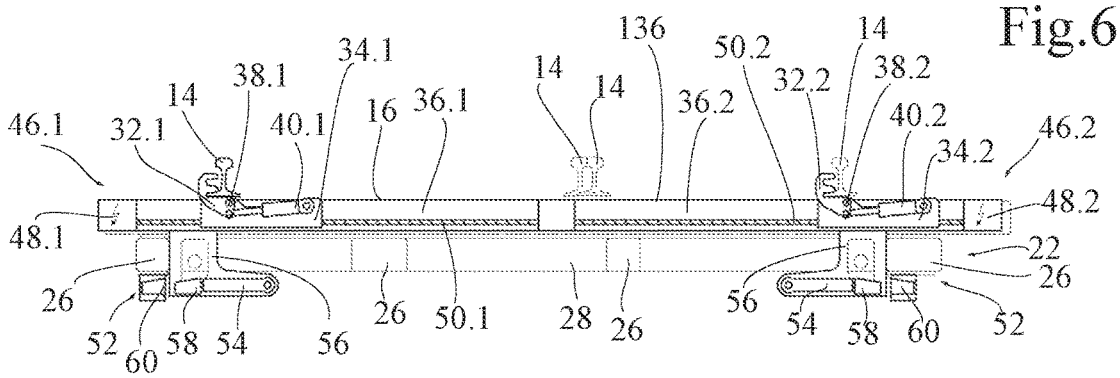
FIG. 6, a schematic front view of the rail apparatus securing system of the transport wagon of FIG. 1, in a position in which it accosts the rail apparatus.
Figure 7:
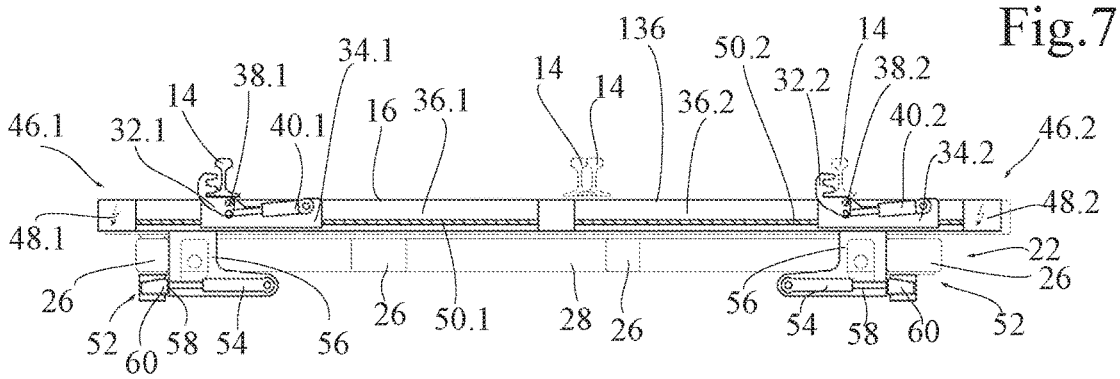
FIG. 7, a schematic front view of the rail apparatus securing system of the transport wagon of FIG. 1, in a position of locking the rail apparatus.

What is meant here by a self-locking actuator is an actuator that does not require the supply of external energy in order to hold it in at least certain reference positions, and notably in the fixing position of FIGS. 6 and 7. This may be an actuator able to hold itself in any chosen position within a predetermined positioning range. It may notably be obtained by providing an actuator comprising an irreversible transmission mechanism, for example using a leadscrew, between a drive member and the fixing member. It is also possible to conceive of a hydraulic ram (as illustrated in the figures) combined with a ram rod clamping device, like that described for example in document FR 2 021 471 or in document WO03/046389.

Each fixing member 32.1, 32.2 forms a double hook, with two catching zones 42, 44 (cf. FIG. 5) which are situated, in the fixing position, at different heights above the associated carriage 34.1, 34.2. This allows the mechanism to be used equally with rail apparatus with (low height) concrete crossties or wood (greater height) crossties. In any case, one of the catching zones 42, 44 is intended to engage with the base of one of the rails 14 of the rail apparatus 12, between two crossties 16 of the rail apparatus 12. In this embodiment, the fixing members 32.1, 32.2 face transversely on the one same side, in this instance in such a way that the catching zones 42, 44 in the inclined position of FIG. 2, are open toward the top.

The carriage 34.1, 34.2 is guided on the associated guideway 36.1, 36.2 by any appropriate means, which limits to one the number of degrees of freedom of the carriage with respect to the guideway. The carriage 34.1, 34.2 and the guideway 36.1, 36.2 have been illustrated schematically in the figures. In practice, the guideway 36.1, 36.2 may be provided with raceways, for example four raceways, along which rollers or balls associated with the carriage run. It may equally be a guideway provided with slipways for shoes formed on the carriage. The guideway thus defines a linear path, preferably a rectilinear path, for the carriage. This path is parallel to the reference plane. In practice, the guideway 36.1, 36.2 may be made up of a solid rail at the periphery of which the raceways or slideways are formed, for example a rail of substantially square or rectangular section the corners of which are machined to form four raceways or slideways. In such a scenario, the carriage may have the overall shape of a U or of an O so as to surround the rail that forms the guideway. Alternatively, the guideway may be made up of a hollow rail having a groove forming a longilinear cavity, in which at least some of the raceways or slideways are formed, and into which at least part of the carriage penetrates.

A drive mechanism 46.1, 46.2 is associated with each carriage 34.1, 34.2 and causes it to move with respect to the associated guideway 36.1, 36.2. The drive mechanism 46.1, 46.2 may for example be a mechanism combining an electric motor 48.1, 48.2 and a leadscrew 50.1, 50.2, as illustrated in the figures.

As illustrated in the figures, two carriages 34.1, 34.2 each bearing a fixing member 32.1, 32.2, are associated with two guideways 36.1, 36.2 formed in the continuation of one another on a common crossbeam 136. The crossbeam 136 constituting the two guideways 36.1, 36.2 is fixed removably and adjustably to the support platform 22 by means of a wedge-type locking device 52. This device comprises, at each end of the crossbeam 136, a hydraulic actuator 54 pivot mounted on a flange 56 secured to the crossbeam 136 and allowing the moving of a locking member consisting of a chamfered wedge, to bring it into engagement with a corresponding inclined wall 60 of a locking cavity 62 formed in a component secured to a longitudinal member 26 of the support platform 22. The inclined wall 60 has, in the longitudinal direction of the platform, a larger dimension D than the chamfered wedge 58, which means that there is a certain degree of freedom for positioning of each end of the transverse beam 136 in the longitudinal direction of the platform with a travel that may be as much as 50 cm (25 cm on either side of a mid position), thereby allowing the transverse beam to be made to effect a translational movement or pivoted about a vertical axis, through an angle of an amplitude that may be as much as 10° (+/−5° on either side of the middle transverse position illustrated in the figures). Longitudinal actuators 64 are provided between the support platform 22 and the transverse beam 136 in order to make the required adjustments.

The securing mechanism consisting of the guideways 36.1, 36.2, the carriages 34.1, 34.2 bearing the fixing members 32.1, 32.2, the locking members 58, the associated cavities 62, and the various actuators 40.1, 40.2, 46.1, 46.2, 54 exists in a number of identical copies, in this instance at least two, distributed along the length of the support platform 22.

Figure 3:
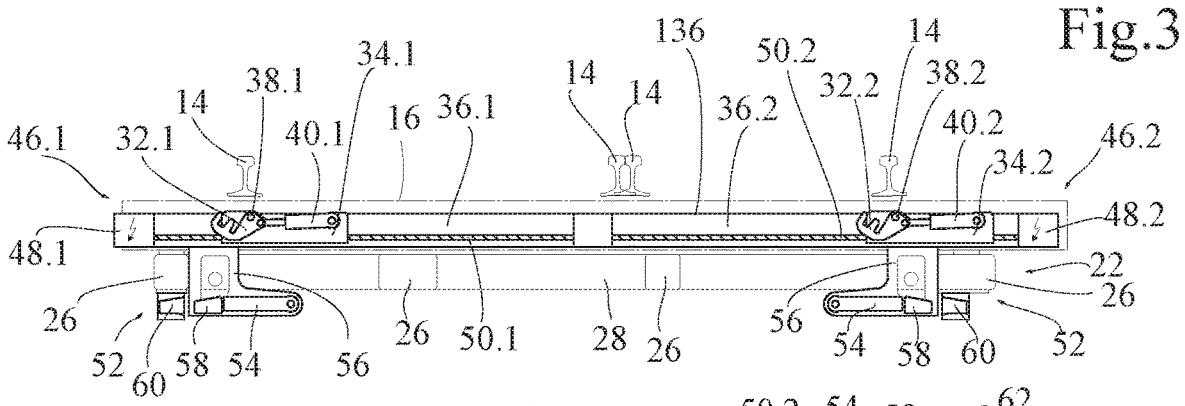
FIG. 3, a schematic front view of the rail apparatus securing system of the transport wagon of FIG. 1, in a retracted position.
Figure 4:
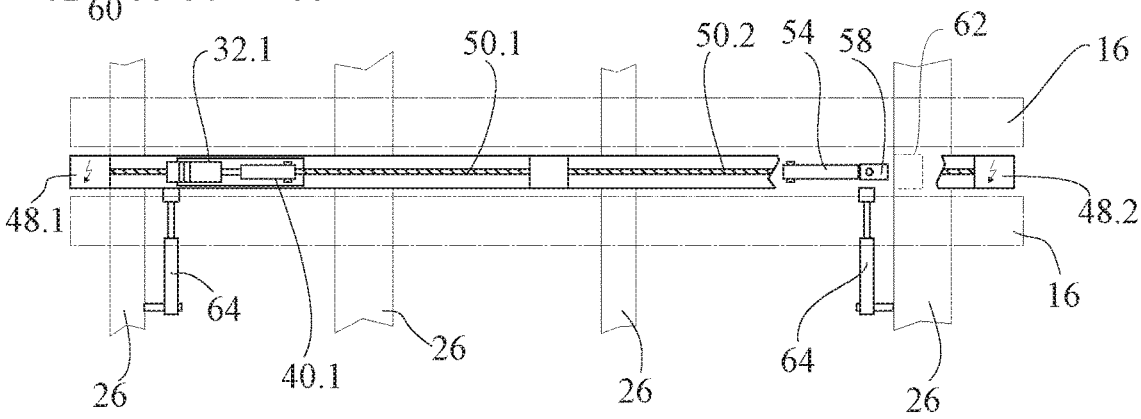
FIG. 4, a schematic view from above of the rail apparatus securing system of the transport wagon of FIG. 1, in the retracted position.
Figure 5:
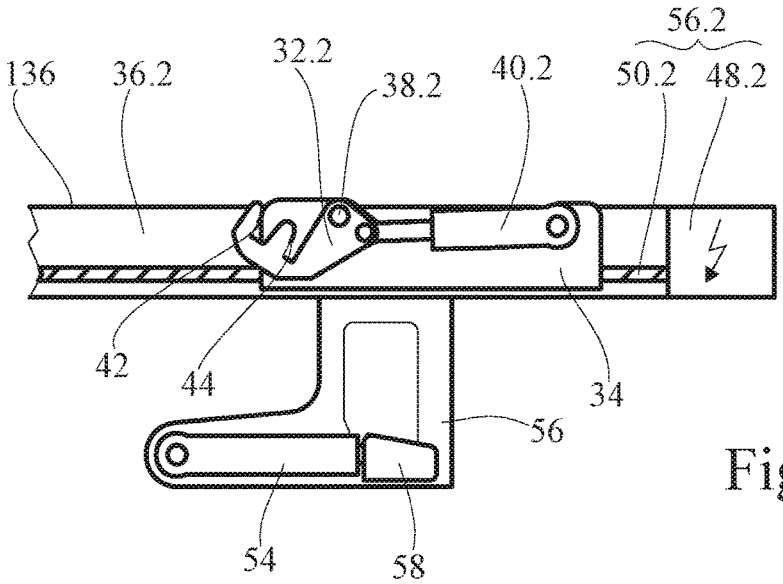
FIG. 5, a schematic view of a detail of the rail apparatus securing system of the transport wagon of FIG. 1, in the retracted position.

The rail apparatus 12 is secured to the platform 22 in a sequence of operations illustrated in FIGS. 3, 6 and 7. In FIG. 3, the rail apparatus 12 has been placed on the support platform 22, the crossties 16 of the rail apparatus 12 resting on the longitudinal members 26 of the support platform 22, if appropriate with the interposition of cushioning pads. The rail apparatus 12 has been positioned in such a way that the transverse beam 136 is positioned between two crossties 16. The fixing members 32.1, 32.2 are retracted, in order to avoid any interference with the rail apparatus 12 during handling. An operator then operates the electric motors 48.1, 48.2 and the actuators 40.1, 40.2 to adjust the positioning of the carriages 34.1, 34.2 and deploy the fixing members 32.1, 32.2 so as to bring these into engagement with the bases of rails 14 of the rail apparatus 12. During this operation, the locking members 58 are not in contact with the inclined walls 60, which means that the positioning of the transverse beam 136 can also be adjusted using the actuators 64 according to how the rail apparatus 12 is positioned. At the end of this operation, the securing mechanism is in the transient position illustrated in FIG. 6.

The transverse beam 136 is locked after a suitable position has been found and after the carriages 34.1, 34.2 have been positioned and the fixing members 32.1, 32.2 brought into engagement with the bases of two rails 14 of the rail apparatus. Extending the actuators 54 causes the chamfered wedges 58 to move away from one another, bringing them into contact with the corresponding inclined walls 60. The essentially horizontal locking force generated by the actuators 54 brings about, at the interface between the chamfered wedges 58 and the inclined walls 60 loads which have a downward vertical component so that the transverse beam 136 is urged downward. These loads are transmitted by the guideways 36.1, 36.2 to the carriages 34.1, 34.2 and to the hooks 32.1, 32.2 that form the fixing members, with the effect of increasing the pressure of contact between the catching zone 42, 44 used and the base of the rail 14. This results in the rail apparatus 12 being gripped between the fixing members 32.1, 32.2 and the platform 22. The pressure of contact between the chamfered wedges 58 and the inclined walls 60 generates high static friction loads which lock the beam 136 to the platform 22 in all directions. The actuators 54 of the locking members 58 are of the self-locking type, which means that there is no need to supply energy in order to keep them locked.

The same procedure is performed for each of the locking mechanisms, in parallel or sequentially.

Once the rail apparatus 12 is thus secured to the support platform 22, it is possible to raise the latter into the position of FIG. 2 for transport.

The unloading operations are performed in the reverse order to the loading operations.

If appropriate, just one of the two fixing members 32.1, 32.2 associated with the transverse beam 136 may be positioned in engagement with one of the rails 14 of the rail apparatus 12, the other fixing member 32.1, 32.2 remaining in the retracted position.

Figure 8:
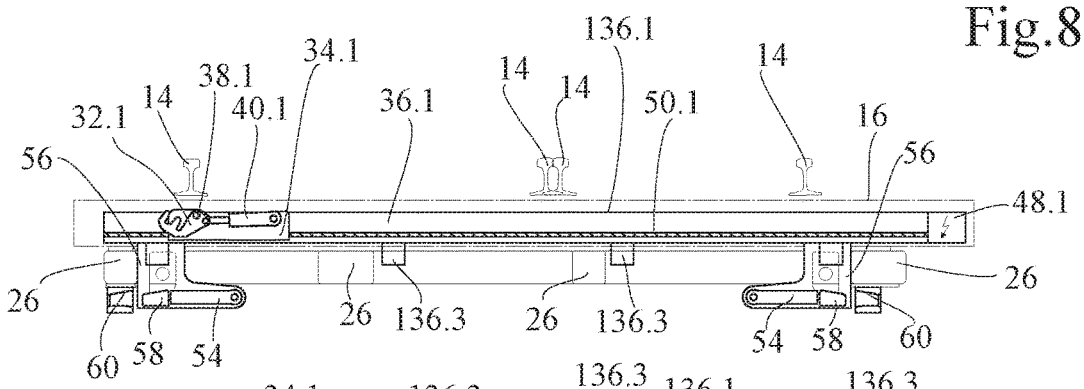
FIG. 8, a schematic front view of a rail apparatus securing system according to a second embodiment of the invention, in a position of positioning the rail apparatus.
Figure 9:
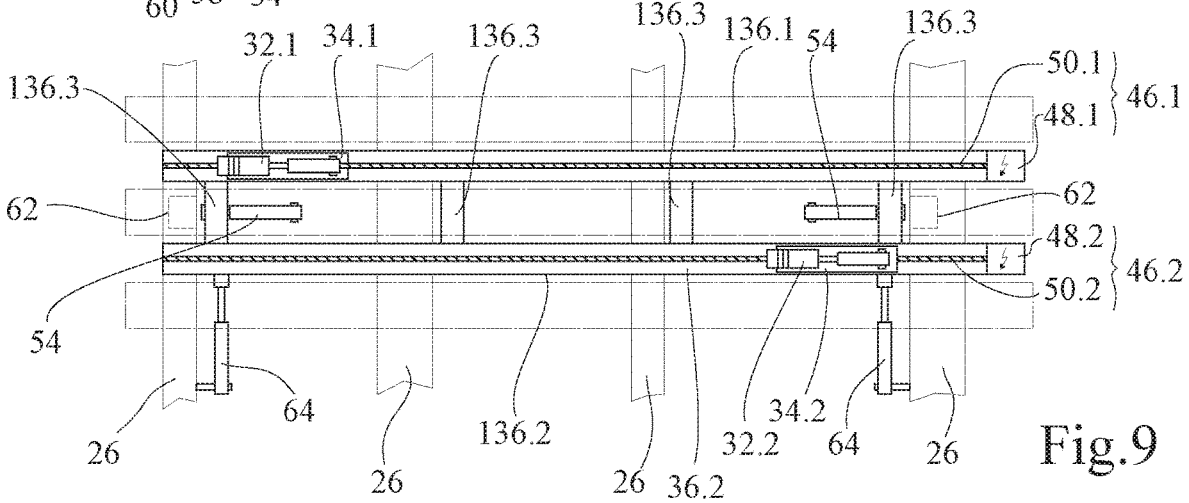
FIG. 9, a schematic view from above of the rail apparatus securing system of FIG. 8, in the position of positioning the rail apparatus.

According to an alternative form of embodiment illustrated in FIGS. 8 and 9, two carriages 34.1, 34.2 each bearing a fixing member 32.1, 32.2 are associated with two parallel guideways 36.1, 36.2 formed on two parallel transverse beams 136.1, 136.2 fixed to one another by beams 136.3 so as to form a rigid subassembly. This arrangement allows a wider range for the positioning of each carriage 34.1, 34.2 along the path of the associated guideway. A drive mechanism 46.1, 46.2 is associated with each carriage 34.1, 34.2 and moves it relative to the associated guideway 36.1, 36.2. The drive mechanism 46.1, 46.2 may for example be a mechanism that combines an electric motor 48.1, 48.2 with a leadscrew 50.1, 50.2, as illustrated in the figures.

Figure 10:
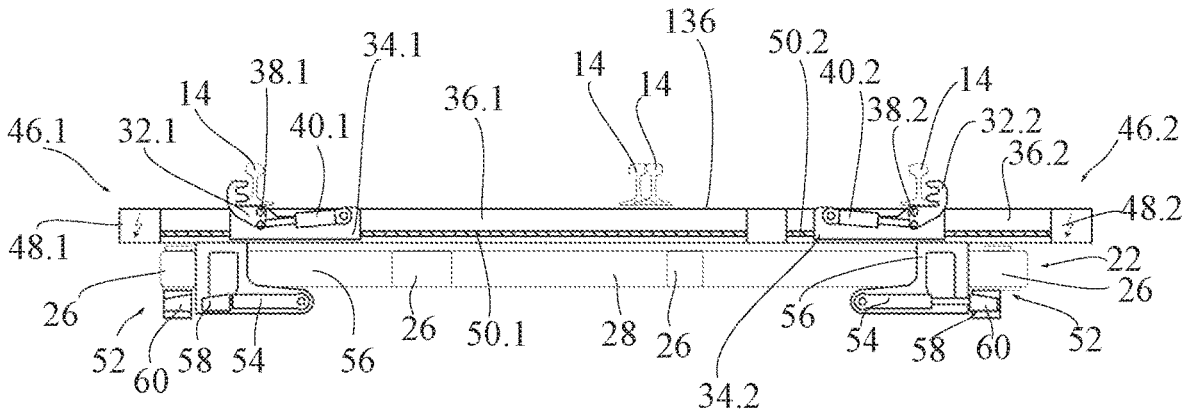
FIG. 10, a schematic front view of a rail apparatus securing system according to a third embodiment of the invention, in a position of positioning the rail apparatus.
Figure 11:
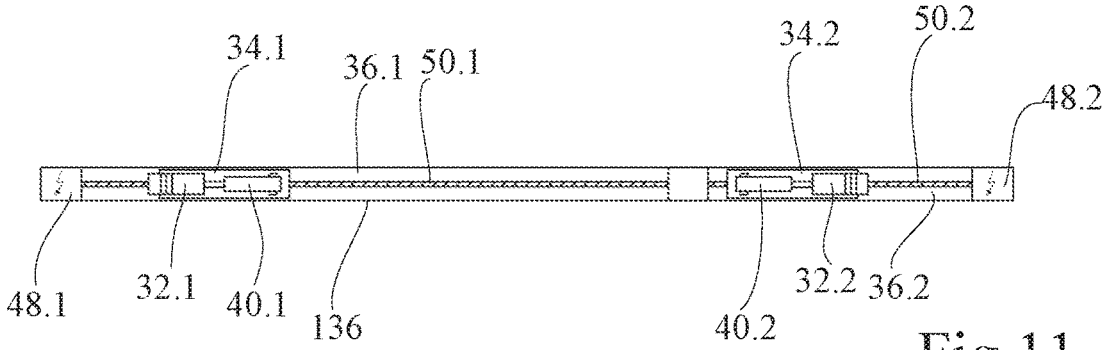
FIG. 11, a schematic view from above of the rail apparatus securing system of FIG. 10, in the position of positioning the rail apparatus.

According to another alternative form of embodiment illustrated in FIGS. 10 and 11, two carriages 34.1, 34.2 each bearing a fixing member 32.1, 32.2 are associated with two aligned guideways 36.1, 36.2 formed on the one same transverse beam 136. In this embodiment, the guideways 36.1, 36.2 have substantially different lengths, the travel of the carriage 34.1 being markedly greater than the travel of the carriage 34.2. This arrangement is particularly well suited to rail apparatus 12 in which the rail 14 intended to engage with the fixing member 32.2 is at a position that varies very little, whereas the positioning of the rail 14 intended to engage with the fixing member 32.1 is liable to vary more.

Furthermore, the fixing members 32.1, 32.2 face transversely toward one another, which means to say such that the catching zones 42, 44 face one another. It will be appreciated that when the two fixing members 32.1, 32.2 are engaged, the rail apparatus is locked laterally.

In practice, one and the same transport wagon may be equipped with securing mechanisms according to one or more of the various embodiments illustrated in the figures, distributed along the length of the platform, so as to adapt locally to suit the configuration of the rail apparatus 12.

Naturally, the examples depicted in the figures and discussed hereinabove are given merely by way of nonlimiting illustration. Various alternative forms are conceivable.

The loading and unloading position of the platform is not necessarily horizontal, but may rather be inclined, although naturally less so than the transport position.

The movement of the fixing member with respect to the carriage may be not a pivoting but a translational movement, or the compound of a translational and of a rotational movement, preferably with just one degree of freedom. It is preferably a planar movement, parallel to a vertical plane. It may notably be a movement obtained by the deformation of an articulated quadrilateral, particularly an articulated parallelogram.

The fixing member may be adapted so that it catches not on the base of the rail 14 but on the crosstie 16 of the rail apparatus 12. In that case, it is notably conceivable for the fixing member 32.1, 32.2 to rotate about a transverse horizontal axis of pivoting.

The guiding of the carriage along the path defined by the guideway can be achieved using any appropriate means.

It is explicitly envisioned that the various embodiments illustrated can be combined in order to propose others.

It is emphasized that all the features, as can be derived by a person skilled in the art from the present description, from the drawings and from the attached claims, even if they have been described in concrete terms only in connection with determined other features, either individually or in any combination, may be combined with other features or groups of features divulged here, provided that so doing has not been expressly precluded and provided that the technical circumstances have not rendered such combinations impossible or pointless.

The invention claimed is:

1. A system for securing railway apparatus, comprising:

a support platform able to be positioned in a loading position, and at least one securing mechanism for securing the railway apparatus to said support platform and configured to pass from an unlocked state into a locked state;

said securing mechanism including:

at least one guideway;

at least one carriage guided by said guideway along a path which, when said support platform is in the loading position, is disposed in a reference plane a motorized or nonmotorized drive mechanism for moving said carriage along said guideway;

a device for blocking said carriage with respect to said guideway;

at least one railway apparatus fixing member, secured to said carriage; and members for locking said guideway with respect to said platform, said members passing from an unlocked position to a locked position when said securing mechanism passes from the unlocked state to the locked state with said support platform in the loading position, and urging said guideway downward with respect to said support platform.

2. The securing system according to claim 1, wherein said carriage drive mechanism comprises a driving and/or operating member situated on one side of said platform.

3. The securing system according to claim 1, wherein said drive mechanism is a self-locking drive mechanism.

4. The securing system according to claim 1, wherein said locking members are driven from the unlocked state into the locked state by a motorized actuator and/or an energy accumulator.

5. The securing system according to claim 1, wherein said fixing member is capable of movement with respect to said carriage between at least a retracted position and a fixing position, said fixing member in the retracted position is situated, when said support platform is in the loading position, beneath a fixing plane parallel to the reference plane and situated above said guideway and said carriage, and said fixing member in the fixing position is situated, when the support platform is in the loading position, at least partially above the fixing plane.

6. The securing system according to claim 5, further comprising a motorized actuator and/or an energy accumulator configured for moving said fixing member between the retracted position and the fixing position.

7. The securing system according to claim 5, wherein said fixing member mounted for rotational movement about a pivoting axis between the retracted position and the fixing position.

8. The securing system according to claim 1, wherein said fixing member comprises two catching zones situated, when said support platform is in the loading position and said fixing member is in the fixing position, at different heights.

9. The securing system according to claim 1, wherein said support platform is configured for movement between the loading position and an inclined transport position.

10. The securing system according to claim 9, wherein said support platform is pivotally mounted for rotation about at least one horizontal pivot axis.

11. The securing system according to claim 10, wherein a path of said carriage extends at least in a direction perpendicular to the pivot axis.

12. The securing system according to claim 1, wherein said securing mechanism comprises:

at least one other guideway secured to said guideway;

at least one other carriage guided by said other guideway along a path which, when said support platform is in the loading position, is parallel to the reference plane;

a blocking device for blocking said other carriage with respect to said other guideway; and at least one other railway apparatus fixing member, secured to said other carriage.

13. The securing system according to claim 12, wherein said fixing member and said other fixing member have catching zones for catching on said railway apparatus, said catching zones facing toward one another or facing in a common transverse direction, and being configured to catch on a rail base of said railway apparatus.

14. A vehicle for transporting railway apparatus, the vehicle comprising:

a transport chassis supported by sets of bogies; and a securing system according to claim 1 mounted on said transport chassis.

15. The vehicle according to claim 14 configured as a rail car for transporting railway apparatus.

* * * * *